US005381851A

United States Patent [19]

Bilz et al.

[11] Patent Number: 5,381,851

[45] Date of Patent: Jan. 17, 1995

[54] LOW PRESSURE CHILL CASTING METHOD FOR CASTING METAL CAST COMPONENTS

[75] Inventors: Georg Bilz, Nürnberg; Hans Lämmermann, Schwabach; Alfred Dobner, Rosstal; Klaus Sterner; Klaus Riess, both of Nüernberg, all of Germany

[73] Assignee: Alcan Deutschland GmbH, Germany

[21] Appl. No.: 768,748

[22] PCT Filed: Jul. 25, 1990

[86] PCT No.: PCT/EP90/01222

§ 371 Date: Oct. 18, 1991

§ 102(e) Date: Oct. 18, 1991

[87] PCT Pub. No.: WO91/01832

PCT Pub. Date: Feb. 21, 1991

[51] Int. Cl.[6] ..... B22D 18/04

[52] U.S. Cl. ..... 164/119; 164/122

[58] Field of Search ..... 164/119, 222, 306, 309, 164/348, 63, 254, 255, 359, 360

[56] References Cited

U.S. PATENT DOCUMENTS

| | | | |
|---|---|---|---|
| 2,794,224 | 6/1957 | Sylvester | 164/359 |
| 3,727,674 | 4/1973 | Chatourel et al. | 164/119 |
| 4,616,689 | 10/1986 | Denis | 164/119 |
| 4,875,518 | 10/1989 | Imura et al. | 164/119 |

FOREIGN PATENT DOCUMENTS

| | | | |
|---|---|---|---|
| 3247129 | 6/1984 | Germany . | |
| 3824609 | 1/1990 | Germany | 164/119 |
| 56-47262 | 4/1981 | Japan . | |
| 0058968 | 4/1982 | Japan | 164/306 |
| 0180360 | 7/1988 | Japan | 164/119 |
| 2241655 | 9/1990 | Japan | 164/360 |
| 662962 | 11/1987 | Switzerland . | |
| 0524677 | 8/1940 | United Kingdom | 164/309 |

OTHER PUBLICATIONS

DE-Z. "Giesserei-Praxis" Niederdruck-Kokillenguss—Heutiger Stand der Technik by A. W. Plume, Nov. 1986, S. 294-298.

DE-Z. "Giesserei" Das Niederdruck-Kokillengiessverfahren für Leichtmetallegierungen by V. E. Bertram, 49 (1962), S. 332-341.

"Kokillen für Leichtmetallguss", Professor Dr.-Ing. Philipp Schneider, Handbuch der Konstruktion, Herstellung und Verwendung von Kokillen für die Leichtmetallgisserei, Giesserei-Verlag, 1986, pp. 205 and 206.

*Primary Examiner*—P. Austin Bradley
*Assistant Examiner*—Erik R. Puknys
*Attorney, Agent, or Firm*—Stevens, Davis, Miller & Mosher

[57] ABSTRACT

A low pressure chill casting method for casting metal components such as cylinder heads or engine blocks of combustion engines or the like, which cast components have wall portions which are locally predominently thinner than in their other regions. In this method, by means of gas pressure, liquid metal is forced from a melt container through a riser tube into a mold. According to the invention, the mold is so arranged that therein the thicker wall portion of the cast component is cast upwardly remote from the gating and the thinner wall portion is cast downwardly in the vicinity of the gating, the liquid metal being introduced at or near the lower region of the mold in the vicinity of the gating into the mold cavity region forming the thinner wall portion. In this connection, liquid metal can be introduced through a base runner at a plurality of gating positions to the lower region of the mold lying in the vicinity of the gating into the mold cavity region forming the thinner wall portion of the cast component.

5 Claims, 1 Drawing Sheet

LOW PRESSURE CHILL CASTING METHOD FOR CASTING METAL CAST COMPONENTS

BACKGROUND OF THE INVENTION

The invention relates to a low pressure chill casting method for casting metal castings such as cylinder heads or engine blocks of combustion engines or the like, which cast components have walls which are considerably thinner in some regions than in their remaining regions, in which method by means of gas pressure liquid metal is forced from a melt container through a riser tube into a mold.

While in known gravity chill casting methods during charging metal is allowed to fall over the entire mold height, whereby strong turbulence occurs in the mold with the known disadvantageous consequences for the metal structure, in known low pressure chill casting methods by introducing the metal into the mold from beneath and allowing it to rise in the mold quieter metal flow is achieved, the molding speed being adaptable at each phase to the desired mold filling. According to previously generally accepted teaching, in known low pressure casting methods the casting molds are so arranged that the thickest wall parts of the cast component lie in the vicinity of the gating, while the thin walled regions lie spaced therefrom. This takes place with a view to enabling feeding of the cast component during its solidification exclusively by melt subsequently pressed from the riser tube, i.e. the solidification should begin in the regions of the cast component remote from the gating and propagate to the gating (see handbook "Kckillen fur Leichtmetallguss" by Professor Philipp Schneider, Giesserei-Verlag 1986, pages 205 and 206). Since in such a situation for the mold the predominantly thick walled regions of the cast components in the vicinity of the gating solidify relatively slowly in the mold, the formation of coarse crystalline structure with precipitation of coarse inter-metallic compounds in this region of the casting is the result. This has however proved to be very unsatisfactory with cast components which in use are subject to high loading in the region of their predominently thicker wall portions, as is for example the case in cylinder heads in the combustion region. A further disadvantage of these known methods of operation arises in that to achieve trouble free mold filling into the thin wall regions it is necessary to work with correspondingly increased casting temperatures which in turn must act disadvantageously on the overall solidification time, i.e. the duration of a casting cycle and also on the casting quality.

OBJECTS AND SUMMARY OF THE INVENTION

A principal object of this invention is preventing the disadvantages of the known low pressure chill casting method. This is achieved according to the invention in that in this casting method the mold is so arranged that its mold cavity regions forming the thicker wall portions of the cast component lie remote from the gating and its mold cavity regions forming the thinner wall portions lie near the gating, the liquid metal being introduced at or near the region of the mold lying near the gating into the mold cavity regions forming the thinner wall portions.

Normally, in this connection the regions of the mold cavity remote from the gating are uppermost and the regions of the mold cavity near the gating are underneath. It has proved that with this method of operation contrary to previously well-established and strictly maintained practice, particularly fault free cast components can be obtained under advantageous production conditions. Using the turbulence-free mold filling given in the low pressure casting method, in this connection foam formation and oxide inclusions are prevented and altogether favorable prerequisites for the production of high quality cast components are created.

By the introduction of the liquid metal into the regions of the mold cavity lying near the gating and forming the thinner wall portions of the cast component and thus having smaller cross-section, the introduced metal is cooled in this region of the mold as it rises within the mold so that with relatively low temperatures it reaches the larger mold cavity regions located uppermost and forming the thicker wall portions of the cast component without danger that any portion of the mold cavity could be insufficiently filled. In this connection, heating of the thinner mold cross-section in the vicinity of the gating and traversed by all metal volume prevents premature solidification of the mold cavity regions near the gating. The relatively great mold filling speed possible in comparison with gravity chill casting in low pressure casting methods without danger of turbulence even permits the wall portions of the cast component to be constructed thinner in this region than usual if this is acceptable for the component to be cast on strength considerations, whereby a saving of material costs can be achieved in the manufactured cast component. The manufacture of a cast component with at least locally thinner wall portions offers in turn the advantage that altogether lower metal volumes are required and during solidification lower volumes need to be fed in and that the overall casting cycle consisting of mold filling time, solidification time, and set up time is shortened. Since in the method according to the invention the metal reaching the upper larger mold cavity regions in the rising low pressure mold casting is already largely cooled, rapid solidification of the metal is achieved in this region which leads to fine crystalline structure in the cast component which offers the possibility for optimal strength properties. As a result, with the method according to the invention it is possible to manufacture cast components such as cylinder heads, engine blocks or the like, even in their stressed regions, with smaller wall thickness than is today usual without the danger being created that they will no longer meet the requirements for sufficient strength during use. Smaller wall thicknesses of the cast component even in these regions mean, however in turn, more rapid mold filling and more rapid solidification of the cast component and thus better material properties.

In the method according to the invention, expediently the liquid metal is introduced through a base runner at a plurality of gating positions into the region of the mold lying in the vicinity of the gating into the mold cavity regions forming the thinner wall portions of the cast components. The regions of the mold cavity near the ingate are heated by the flowing metal to an extent such that in spite of the smaller cross-section they are maintained relatively long without solidification and at least locally further feeding of the mold can be performed during the final pressurization phase from the gating.

If necessary, further topping-up with liquid metal at several positions of the side of the mold remote from the gating is possible by employing a feeder into the larger mold cavity regions forming the thicker wall portions of the cast component. Since this topping up must normally only have a small range, relatively small feeders are sufficient, whereby in turn undesired heating of the overall mold, in particular the upper region of the mold, is largely prevented by the liquid metal located in the feeders.

In contrast to the known low pressure casting method, which in principle is arranged in such manner as to allow solidification of the inlet cross-section of the casting mold as the final section of the cast component situated at the riser tube mouth, in the method according to the invention this inlet cross-section is normally solidified before the remote regions of the cast component. This is in particular of advantage when the low pressure casting furnace is not coupled rigidly to a casting mold, but serves several casting molds in cyclic alternation. The faster the inlet cross-section of the casting mold solidifies, the earlier the riser tube of the low pressure furnace can be decoupled from the casting mold and be connected to another casting mold for the next casting cycle.

BRIEF DESCRIPTION OF THE DRAWINGS

In the following, the casting method according to the invention is described in more detail with reference to the drawings.

Figure 2:
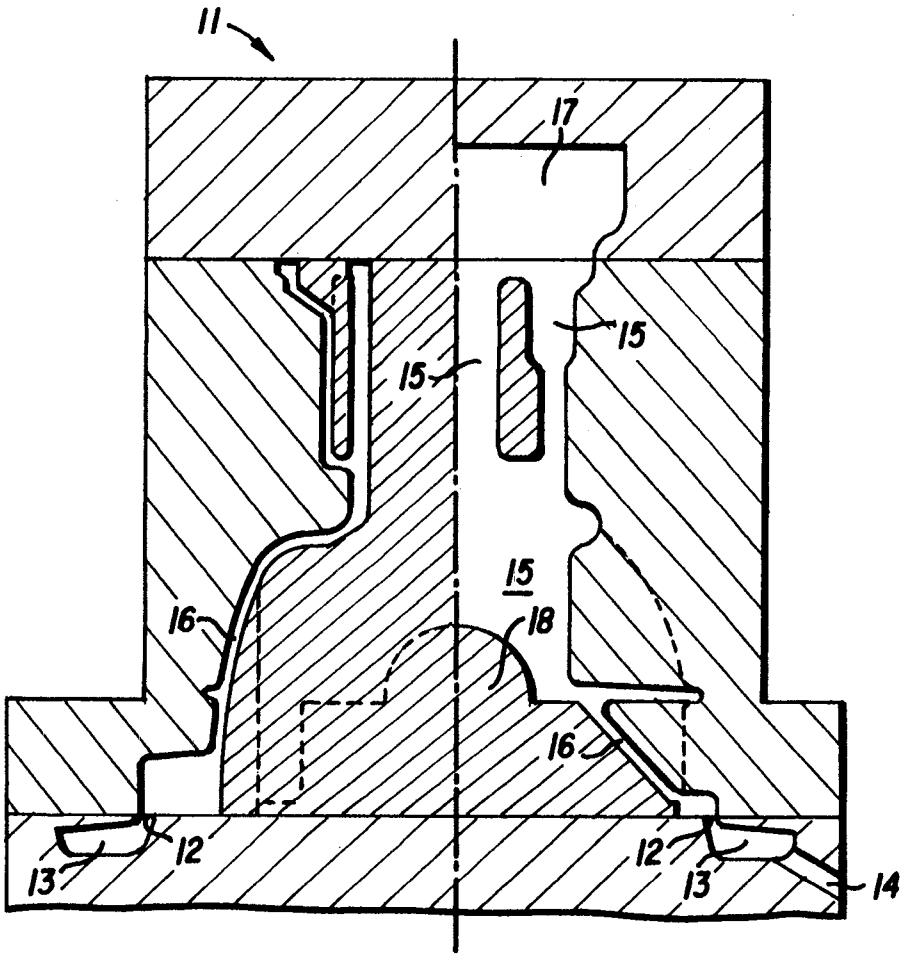
FIG. 2 shows two different partial sections of a mold connected to a riser tube of a low pressure chill casting machine for casting a cylinder block, likewise in schematic view.

In both Figures, the mold which is a known with cores is represented in one piece in order not to influence clarity of the drawing.

Figure 1:
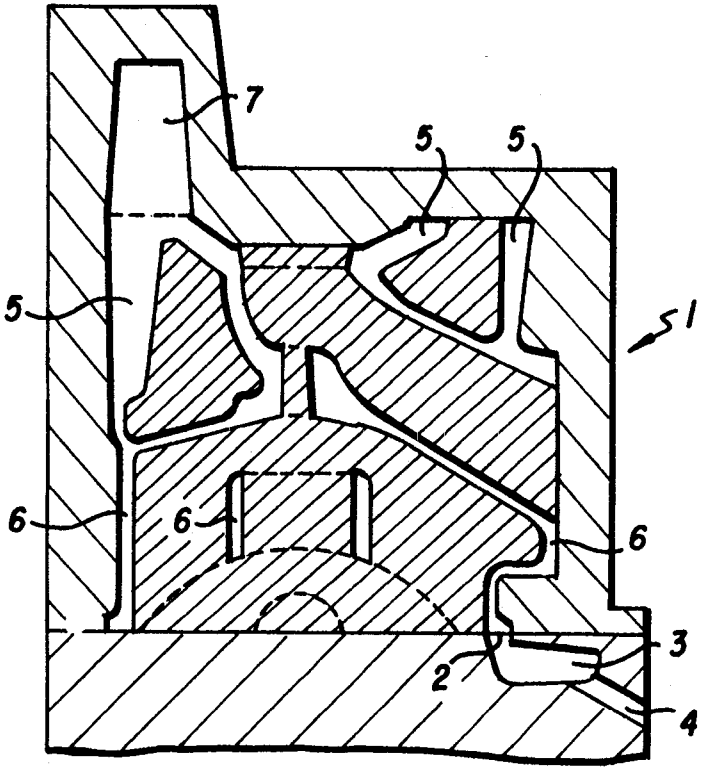
FIG. 1 of the drawings shows a mold connected to a riser tube of a low pressure chill casting machine for casting a cylinder head in cross-section in schematic view.

The mold 1 illustrated in cross-section in FIG. 1 serves for casting a cylinder head which has in general thicker wall portions on its side adjoining a combustion chamber and in its adjoining region than on its opposite side and the adjoining region. The combustion chamber of this cylinder head is delimited by the thicker wall portion which in the mold is formed and surrounded by the obliquely extending wider mold chambers 5 in the upper part of FIG. 1. This mold is connected with a plurality of gating positions 2 via a base runner 3 to the end 4 of a riser tube of a low pressure chill casting machine which is not illustrated, in such manner that its mold cavity region 5 forming the thicker wall region of the cylinder lies above and its mold cavity region 6 forming the thinner wall of the cylinder head lies below. Through the base runner 3, the molten casting metal is first introduced into the lower lying generally smaller or thinner mold cavity region 6. Through this mold cavity region 6 the introduced metal rises substantially turbulence free and quietly upwardly in the mold into the upper generally larger or thicker mold cavity region 5 and into the feeder 7 mounted on the mold which can be expedient for topping up the upper mold cavity region 5. Feeding of the lower mold cavity region 6 is performed via the riser tube and the base runner from the gating.

The mold 11 illustrated in cross-section in FIG. 2 serves for casting a cylinder block which has on its side delimiting the crank shaft chamber 18 and in its adjoining regions generally thinner wall portions than in its regions located thereabove. Also this mold is connected to a plurality of gating positions 12 via a base runner 13 at the end 14 of a riser tube of a low pressure chill casting machine which is not illustrated, and in fact in such manner that its mold cavity region 15 forming the thicker wall portion of the cylinder block lies uppermost and its mold cavity region 16 forming the thinner wall portion of the cylinder block lies beneath. Also here via the base runner 13 the molten casting metal is introduced first of all into the lower generally smaller or narrower mold cavity region 16, through which mold cavity region the metal rises generally without turbulence and quietly upwardly into the mold into the upper generally larger mold cavity region 5 and into the feeder 17 mounted on the mold.

We claim:

1. A method for low pressure chill casting a metal cylinder block which has wall portions which are locally predominately thinner than remaining portions of said cylinder block, said method comprising:

positioning a non-disposable mold so that thinner wall portions thereof for the formation of a crankcase chamber are directed downwardly;

arranging said non-disposable mold so that locally predominately thicker wall portions of the cylinder block are cast remote from a gating and the locally predominately thinner wall portions are cast near said gating;

pressing liquid metal, by means of gas pressure, through said mold from a melt container through a riser tube into said mold approximate to a region of said mold lying in the vicinity of said gating and through said mold into a feeder mounted on said mold, whereby the liquid metal flowing through the thinner wall portions solidifies before the remote regions of the casting which are the predominately thicker wall portions, any shrinkage in said predominantly thicker wall portions being compensated by the liquid metal in said feeder.

2. A method according to claim 1, wherein the liquid metal is introduced via a base runner at a plurality of gating positions into the region of the mold lying in the vicinity of the gating into the mold cavity region forming the thinner wall portion of the casting.

3. A method according to claim 1, wherein final feeding of liquid metal is performed at a plurality of locations on a side of the mold remote from a gating into the mold cavity region forming the thicker wall portion of the casting by a feeder mounted on the mold.

4. A method according to claim 1, wherein a low pressure casting furnace is connected to the casting mold only for one casting cycle and after solidification of the mold entry cross-section or cross-sections said furnace is decoupled from the casting mold.

5. A method for casting a metal cylinder head which has wall portions which are locally predominately thinner than remaining portions of said cylinder head, said method comprising:

positioning a mold so that thicker wall portions thereof for formation of combustion chambers face upwardly;

arranging said mold so that said thicker wall portions are cast remote from a gating and the locally predominately thinner wall portions are cast in the vicinity of said gating;

pressing liquid metal, by means of gas pressure, from a melt container through a riser tube into said mold; and introducing said liquid metal approximate to a region of said mold lying in the vicinity of said gating.

* * * * *

UNITED STATES PATENT AND TRADEMARK OFFICE

CERTIFICATE OF CORRECTION

PATENT NO. : 5,381,851

DATED : January 17, 1995

INVENTOR(S) : Georg BILZ et al

It is certified that error appears in the above-indentified patent and that said Letters Patent is hereby corrected as shown below:

On the title page: Item [30], the Foreign Application Priority Data should read:

-- [30] Foreign Application Priority Data

July 26, 1989 [DE] Germany ..... 3924742 --

Signed and Sealed this

Eighteenth Day of July, 1995

*Attest:*

Bruce Lehman

BRUCE LEHMAN

*Attesting Officer*

*Commissioner of Patents and Trademarks*